US005779938A

United States Patent [19]

Naraghi et al.

[11] Patent Number: 5,779,938

[45] Date of Patent: Jul. 14, 1998

[54] COMPOSITIONS AND METHODS FOR INHIBITING CORROSION

[75] Inventors: Ali Naraghi, Missouri City; Philippe Prince, Pearland, both of Tex.

[73] Assignee: Champion Technologies, Inc., Fresno, Tex.

[21] Appl. No.: 518,985

[22] Filed: Aug. 24, 1995

[51] Int. Cl.[6] ..... C09K 3/00; C09K 7/00; C23F 11/00

[52] U.S. Cl. ..... 252/391; 252/389.62; 252/392; 252/394; 252/395; 422/12; 422/16; 422/17; 507/239; 507/240; 507/242; 507/258; 507/267; 507/939

[58] Field of Search ..... 507/239, 240, 507/242, 258, 260, 247, 267, 939; 252/391, 389.62, 395, 394, 392; 422/12, 16, 17; 106/14.16, 14.24; 208/47, 48 AA

[56] References Cited

U.S. PATENT DOCUMENTS

| | | | |
|---|---|---|---|
| 2,262,428 | 11/1941 | Lietz | 507/242 |
| 3,197,403 | 7/1965 | Riggs | 507/258 |
| 3,210,376 | 10/1965 | Smith | 260/343.6 |
| 3,458,453 | 7/1969 | Kautsky | 252/392 |
| 3,502,557 | 3/1970 | Yurchesen etal. | 204/181 |
| 3,933,531 | 1/1976 | Sawa et al. | 148/6.14 R |
| 4,026,915 | 5/1977 | Billman et al. | 558/252 |
| 4,028,268 | 6/1977 | Sullivan, III et al. | 252/507 |
| 4,073,924 | 2/1978 | Sonntag | 514/106 |
| 4,106,904 | 8/1978 | Oude Alink et al. | 21/2.7 R |
| 4,113,709 | 9/1978 | Quinlan | 424/8 |
| 4,139,530 | 2/1979 | Kalk et al. | 544/234 |
| 4,189,453 | 2/1980 | Zinke et al. | 558/987 |
| 4,197,209 | 4/1980 | Zinke et al. | 252/558 |
| 4,216,097 | 8/1980 | Stournas | 507/166 |
| 4,251,469 | 2/1981 | Zinke et al. | 558/252 |
| 4,357,221 | 11/1982 | Lehner et al. | 204/522 |
| 4,410,675 | 10/1983 | Demmer | 525/428 |
| 4,417,023 | 11/1983 | Sinka et al. | 524/522 |
| 4,436,878 | 3/1984 | Batzill et al. | 525/204 |
| 4,478,602 | 10/1984 | Kelley et al. | 44/252 |
| 4,578,438 | 3/1986 | Demmer et al. | 525/524 |
| 4,692,317 | 9/1987 | Greaves | 422/252 |
| 4,740,320 | 4/1988 | Treybig et al. | 252/8.555 |
| 4,762,627 | 8/1988 | Martinez et al. | 252/8.555 |
| 4,882,090 | 11/1989 | Batzill et al. | 252/524 |
| 4,889,883 | 12/1989 | Rosenberg et al. | 524/289 |
| 4,954,275 | 9/1990 | Rosenberger et al. | 252/48.6 |
| 4,988,420 | 1/1991 | Batzill et al. | 204/252 |
| 5,009,799 | 4/1991 | Syrinek et al. | 507/939 |
| 5,032,318 | 7/1991 | Bartlett | 252/392 |
| 5,120,356 | 6/1992 | Phillips et al. | 106/252 |
| 5,152,929 | 10/1992 | Bentley et al. | 252/548 |
| 5,235,082 | 8/1993 | Hill et al. | 556/502 |
| 5,250,325 | 10/1993 | Phillips et al. | 427/106 |
| 5,275,744 | 1/1994 | Ho | 507/106 |
| 5,288,315 | 2/1994 | Braig et al. | 106/14.15 |
| 5,347,008 | 9/1994 | Bentley et al. | 548/170 |
| 5,417,771 | 5/1995 | Arita et al. | 148/23 |
| 5,427,661 | 6/1995 | Geist et al. | 204/524 |

*Primary Examiner*—Sharon Gibson
*Assistant Examiner*—Deanna Baxan
*Attorney, Agent, or Firm*—Vinson & Elkins L.L.P.

[57] ABSTRACT

The invention is an effective, easy to produce, and economical corrosion inhibitor which can be used in a variety of environments. The corrosion inhibitor of the present invention is the salt of certain tertiary amines. The corrosion inhibitor is the reaction product of one or more tertiary amines and certain carboxylic acids, preferably a mixture of mercaptocarboxylic and carboxylic acids.

35 Claims, No Drawings

COMPOSITIONS AND METHODS FOR INHIBITING CORROSION

FIELD OF THE INVENTION

The present invention relates to compositions and methods for inhibiting the corrosion of iron, steel, and ferrous alloys. More specifically, this invention relates to corrosion inhibitors which are a mixture of carboxylic and mercaptocarboxylic acids salts of trialkylamines, alkylpyridines, or alkylquinolines and methods for their use.

BACKGROUND OF THE INVENTION

While the corrosion inhibitor compositions and methods of the present invention are useful for inhibiting corrosion in a variety of environments, their application to oil and gas production is particularly illustrative. Specifically, the oil and gas industry has experienced a long-standing problem with corrosion of oil and gas pipelines as well as oil and gas production and well drilling equipment which comes in contact with corrosive fluids. Corrosion of pipelines or equipment results in the necessity to shut down production while corroded pipelines and equipment are replaced. Also, corrosion in pipelines sometimes leads to leaks which, in addition to being costly, may create severe environmental hazards.

Because of the severity of the corrosion problem and the concern for environmental conditions many attempts have been made by members of the oil and gas industry to formulate additives to inhibit corrosion. In some applications benzyl chloride quats are commonly used as corrosion inhibitors. However, the cost of manufacturing benzyl chloride quats is high and they are generally less effective than desired.

Consequently, there remains a need in the art for a corrosion inhibitor which is effective for inhibiting corrosion of pipelines and equipment made from iron, steel, and ferrous alloys, is simple to produce and costs less to manufacture than other commercially available corrosion inhibitors.

SUMMARY OF THE INVENTION

The present invention satisfies the need for an effective, easy to produce, and economical corrosion inhibitor that can be used to inhibit corrosion of pipelines and equipment made from iron, steel, and ferrous alloys in a variety of environments. The corrosion inhibitor of the present invention is suitable for use not only with pipelines, oil and gas wells, and transmission lines but also with other industrial equipment which comes in contact with corrosive fluids during its use. Corrosion is inhibited according to the present invention by adding to the corrosive fluid an effective amount of the reaction product of one or more tertiary amines and certain carboxylic acids preferably a mixture of mercaptocarboxylic and carboxylic acids. The corrosion inhibitor of the present invention is a water soluble salt of trialkylamines, alkylpyridines, or alkylquinoline. Other corrosion inhibitors, solvents and additives may be incorporated into or used in conjunction with the corrosion inhibitor of this invention.

DETAILED DESCRIPTION OF THE INVENTION

The present invention is a new and improved composition and method for inhibiting corrosion utilizing a new corrosion inhibitor which is the reaction product of at least one tertiary amine and at least one carboxylic acid, preferably a mixture of mercaptocarboxylic acid and carboxylic acid.

Generally, tertiary amines useful in the preparation of the corrosion inhibitor of the present invention include:

- pyridine derivatives containing 1 to 3 alkyl groups attached to carbon atoms in the pyridine nucleus, such as isomers of picoline, isomers of lutidine and isomers of collidine;
- quinoline and quinoline homologs; and
- trialkylamines in which alkyl groups have from 1 to 22 carbon atoms, may be straight or branched, saturated or unsaturated, and may be aliphatic or may contain aromatic groups. Preferably the alkyl groups are two methyl groups and one saturated or partially unsaturated straight chain aliphatic containing 12 to 22 carbon atoms;

and mixtures of the above.

To keep the costs of producing the corrosion inhibitor of the present invention to a minimum, a bottom stream or residue of a pyridine production reaction may be employed. The bottom stream usually contains numerous tertiary amines, sometimes as many as 50 or more. Depending on the respective proportions, the mixtures of tertiary amines have different Amine Equivalent Weights. The byproducts also contain many other compounds which do not participate in the reaction of the present invention.

The carboxylic acids which may be reacted with the tertiary amines listed above to form the corrosion inhibitor of the present invention include: acetic acid, propanoic acid, butanoic acid, hydroxyacetic acid, hydroxypropanoic acid, hydroxybutanoic acid, mercaptoacetic acid, mercaptopropanoic acid, mercaptobutanoic acid, chloroacetic acid, chloropropanoic acid, and chlorobutanoic acid. Carboxylic acids useful in the present invention are represented by the formula:

$$X—CH_2—(CH_2)_nCOOH$$

wherein n is an integer from 0 to 2 and X is selected from a group consisting of —H, —OH, —SH, and —Cl. When X is —SH, the carboxylic acid is referred to as mercaptocarboxylic acid. It has been found that including a small amount of mercaptocarboxylic acid in the reaction produces a corrosion inhibitor which has proven to be unexpectedly effective at inhibiting corrosion. In fact, the performance of the corrosion inhibitor prepared with mercaptocarboxylic acid is far superior to the performance of any known corrosion inhibitor.

The reaction products of the above listed tertiary amines and carboxylic acids are tertiary amine salts. Specifically, the reaction products are a mixture of carboxylic and mercaptocarboxylic acid salts of trialkylamines or alkylpyridines or alkylquinolines. The reaction products may be represented by the following formulae:

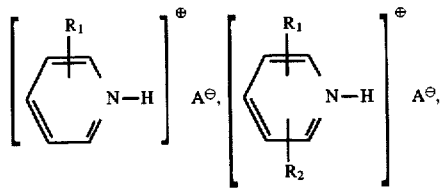

-continued

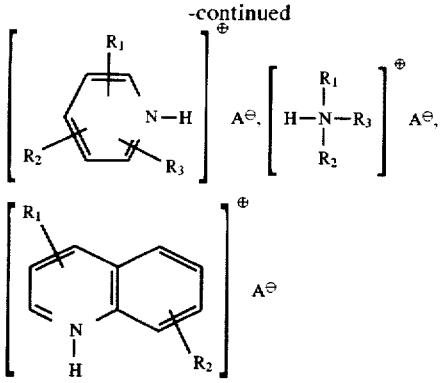

wherein $R_1$, $R_2$, and $R_3$ are alkyl groups, and A is a compound of the following formula;

$$X—CH_2—(CH_2)_nCOO$$

wherein n is an integer from 0 to 2 and X is selected from a group consisting of —H, —OH, —SH, and —Cl.

The corrosion inhibitor of the present invention also generally contains a solvent. The solvent increases the solubility of the reaction products. Because corrosion of metals frequently takes place in the aqueous phase of the corrosive fluid, the solvent of choice is usually water. However, the reaction products of the present invention may also be made to be soluble in isopropyl alcohol, methanol, or a variety of other commonly used solvents. Because salts are highly soluble in water, a small amount of water is usually required for preparing the corrosion inhibitor of the present invention. Often a mixture of water and isopropyl alcohol produce the best results. The choice of solvent and amounts required is obvious to one skilled in the art.

Various additives may also be incorporated into the corrosion inhibitor of the present invention. Isopropyl alcohol, methanol, or other commonly used antifreeze agents may be added to the corrosion inhibitor of the present invention to "winterize" it, i.e., prevent it from freezing in cold climates. Addition of a surfactant generally improves the solubility of the corrosion inhibitor in water. For example, ethoxylated alcohol or amine or any other surfactant can be used. Surfactants are generally effective at a concentration level of 0–30% by weight with optimum performance at about 5–10% by weight. The corrosion inhibitor may also be blended or used in conjunction with other types of corrosion inhibitors.

The corrosion inhibitor of the present invention is prepared by combining the tertiary amines, carboxylic acids, solvents and additives at room temperature and mixing them together for 20–30 minutes. Generally, the tertiary amine and carboxylic acid should be reacted in a molar ratio of 1:1 for complete salting of the tertiary amines. However, other molar ratios also produce salts but may contain unreacted (or excess) amine or acid. Partially salted tertiary amines also inhibit corrosion according to the present invention. A wide range in the amount of ingredients produce effective corrosion inhibitor. The preferred amounts are 28% by weight tertiary amines, 5% by weight carboxylic acid, 30% by weight water, 30% by weight isopropyl alcohol, and 7% by weight surfactant. Of the 5% carboxylic acid, it is preferred that 0.5 to 2.5% by weight be mercaptocarboxylic acid. These amounts produce a 33% by weight salt solution. However, the present invention includes any concentration of the above-described salts. In other words, the corrosion inhibitor of the present invention may be in a very dilute to a very strong solution. Those skilled in the art should be able to adjust the weight percentages of amines, carboxylic acids, solvents, and additives to fit various applications.

Various techniques can be used to provide contact of the corrosion inhibitor with the metal surface to be protected from corrosion. For example, an effective amount of the corrosion inhibitor may be added to the corrosive fluid. The most effective method for inhibiting corrosion of oil and gas pipelines is continuous injection of the corrosion inhibitor into a flowing stream of corrosive fluid such as oil or gas. However, batch additions of the corrosion inhibitor may also be used. One of ordinary skill in the art will be able to employ the corrosion inhibitor of the present invention using any appropriate method.

The corrosion inhibitor of the present invention is useful in preventing or minimizing corrosion of iron, steel, and ferrous alloys. In addition, the corrosion inhibitor may be used in a wide variety of applications where corrosive fluids contact metal parts, including in pipelines, oil and gas wells, transmission lines and other well parts which come in contact with corrosive fluids during oil and gas production. The corrosion inhibitor of the present invention is soluble in water and very simple to produce. The cost of manufacturing the corrosion inhibitor of the present invention is less than other corrosion inhibitors, such as benzyl chloride quats of the same tertiary amines. The corrosion inhibitor of the present invention is also much more effective in preventing corrosion than other commercially available corrosion inhibitors.

The invention will now be illustrated further by reference to the following specific, non-limiting examples. In the following examples all percentages are based on weight unless otherwise indicated.

EXAMPLE 1

Preparation of Corrosion Inhibitor

Twenty-eight percent by weight of a pyridine bottom stream or residue of a pyridine production reaction was combined with 5% by weight ethanoic acid, 30% by weight water, 30% by weight isopropyl alcohol and 7% by weight surfactant. The components of the corrosion inhibitor were mixed together at room temperature for 20–30 minutes. A second corrosion inhibitor was made as above except 4.50% ethanoic acid and 0.50% mercaptoacetic acid were used in place of 5.0% ethanoic acid. Preparation of corrosion inhibitors using various tertiary amines, carboxylic acids, and mercaptocarboxylic acids is similar to the procedure described above and is obvious to those skilled in the art.

EXAMPLE 2

Corrosion Rate Studies

Laboratory screening studies were conducted using the rotating cylinder electrode method to gather data on the performance of the corrosion inhibitors of the present invention as compared to other corrosion inhibitors. The corrosion inhibitors used in the tests were prepared according to the procedure in Example 1 using 30% by weight water, 30% by weight isopropyl alcohol (IPA) and 7% by weight surfactant unless otherwise indicated in Table 1 below. For the benzyl quats, the remaining percentage was benzyl quat of the corresponding tertiary amine. For the corrosion inhibitors of the present invention, the remaining percentage was 5% carboxylic acid, specifically acetic acid, including 0 to 2.5% mercaptocarboxylic acid, specifically mercaptoacetic acid, as indicated in Table 1 and the tertiary amines.

A 1000 mL test vessel was filled with 950 mL of synthetic NACE (National Association of Corrosion Engineers) brine and 50 mL of Kerosene and heated to 170° F. while sparging with carbon dioxide ($CO_2$) to ensure that all dissolved oxygen was purged from the system. A one hour delay was introduced between the brine reaching the required temperature and insertion of the test electrode. After this time the test electrode was lowered into the test vessel and the rotational speed set at 5000 rotations per minute (rpm). The electrode was precorroded under $CO_2$ conditions for 2 hours, monitoring the corrosion rate continuously via Linear Polarization Resistance (LPR). Upon reaching a steady baseline corrosion rate, 50 parts per million (ppm) of the corrosion inhibitor of the present invention was injected into the test vessel and the corrosion rate monitored at 15 minute intervals for 24 hours. The test results shown in Table 1 provide useful information on the effectiveness of some corrosion inhibitors.

TABLE 1

Comparison of the Corrosion Rates of Tertiary Amine Salts to Benzyl Chloride Quats of the Same Tertiary Amines
All Solutions contain by weight 30% IPA, 30% water, and 7% surfactant unless otherwise indicated.
All tests were performed using 50 ppm of the corrosion inhibitor solutions.

| Tertiary Amine % | Mercapto Carboxylic Acid % | Carboxylic Acid % | Corrosion Rate in mils per year (mpy) | | | | |
|---|---|---|---|---|---|---|---|
| | | | Blank | 2 hours | 5 hours | 10 hours | 15 hours |
| Alkylquinolines 28% | .50 | 4.50 | 331.7 | 45.5 | 19.4 | 14.0 | 14.0 |
| Alkylquinolines 28% | 1.25 | 3.75 | 319.7 | 16.8 | 11.5 | 10.5 | 14.3 |
| Alkylquinolines 28% | 2.50 | 2.50 | 298.5 | 17.8 | 10.4 | 8.2 | 6.5 |
| Alkylquinolines 28% | — | 5.00 | 323.5 | 356.1 | 267.9 | 255.1 | 239.0 |
| Alkylquinolines Benzyl Quat 33% | — | — | 311.8 | 255.0 | 242.2 | 243.6 | 245.7 |
| Alkylpyridines (High AEW) 28% | .50 | 4.50 | 248.3 | 29.6 | 21.7 | 20.4 | 20.1 |
| Alkylpyridines (High AEW) 28% | 1.25 | 3.75 | 320.2 | 14.8 | 7.6 | 5.1 | 3.2 |
| Alkylpyridines (High AEW) 28% | 2.50 | 2.50 | 288.5 | 18.9 | 11.2 | 9.3 | 9.0 |
| Alkylpyridines (High AEW) 28% | — | 5.00 | 314.4 | 244.7 | 239.9 | 207.8 | 151.5 |
| Alkylpyridines (High AEW) Benzyl Quat 33% | — | — | 319.0 | 276.4 | 298.7 | 331.6 | 359.3 |
| Alkylpyridines (Med. AEW) 28% | .50 | 4.50 | 310.8 | 46.1 | 25.8 | 25.8 | 25.8 |
| Alkylpyridines (Med. AEW) 28% | 1.25 | 3.75 | 298.4 | 31.2 | 21.1 | 19.6 | 20.4 |
| Alkylpyridines (Med. AEW) 28% | — | 5.00 | 295.0 | 288.8 | 298.4 | 330.5 | 347.7 |
| Alkylpyridines (Med. AEW) Benzyl Quat 33% | — | — | 291.7 | 288.9 | 368.8 | 376.0 | 432.4 |
| Alkylpyridines (Low AEW) 28% | .50 | 4.50 | 310.2 | 124.9 | 108.3 | 115.2 | 115.5 |
| Alkylpyridines (Low AEW) 28% | 1.25 | 3.75 | 305.3 | 41.6 | 18.6 | 12.8 | 12.2 |
| Alkylpyridines (Low AEW) 28% | — | 5.00 | 319.0 | 308.8 | 335.7 | 375.0 | 389.1 |
| Alkylpyridines (Low AEW) Benzyl Quat 33% | — | — | 305.2 | 216.2 | 253.0 | 251.1 | 240.4 |
| Trialkylamine 35% *no surfactant | 1.25 | 3.75 | 306.8 | 10.6 | 8.1 | 7.0 | 6.5 |
| Trialkylamine 35% *no surfactant | — | 5.00 | 325.5 | 118.8 | 58.9 | 44.7 | 40.2 |
| Trialkylamine Benzyl Quat 40% *no surfactant | — | — | 340.4 | 131.0 | 39.1 | 20.7 | 16.0 |

As can be seen from Table 1, the mixed carboxylic and mercaptocarboxylic acids salts of trialkylamines, alkylpyridines, and alkylquinolines are dramatically more effective corrosion inhibitors than the corresponding carboxylic acids salts or the benzyl chloride quats of the same tertiary amines. The carboxylic acids salts and the mixed mercaptocarboxylic and carboxylic acids salts are much less expensive to manufacture than the corresponding benzyl chloride quats. Thus, the corrosion inhibitors of the present invention provide a more effective and more economical alternative to currently used corrosion inhibitors.

Those of ordinary skill in the art will understand that changes and modifications to the specifically described embodiments can be carried out without departing from the scope of the invention which is intended to be limited only by the scope of the appended claims.

What is claimed is:

1. A composition for inhibiting corrosion comprising:

the reaction product of at least one tertiary amine and at least one mercapto carboxylic acid of the formula:

$$SH—CH_2—(CH_2)_n—COOH$$

wherein n is an integer from 0 to 2.

2. The composition as recited in claim 1 wherein said mercapto carboxylic acids are selected from the group consisting of: mercaptoacetic acid, mercaptopropionic acid, mercaptobutanoic acid and mixtures thereof.

3. The composition as recited in claim 1 wherein said tertiary amine(s) are selected from the group consisting of:

quinoline and quinoline homologs;

pyridine derivative having from 1 to 3 alkyl groups attached to carbon atoms in the pyridine nucleus;

trialkylamines having alkyl groups containing from 1 to 22 carbon atoms; and mixtures thereof.

4. The composition as recited in claim 3 wherein said pyridine derivatives are selected from the group consisting of:

isomers of picoline;

isomers of lutidine;

isomers of collidine; and mixtures thereof.

5. The composition as recited in claim 3 wherein said pyridine derivative is a residue of a pyridine production reaction.

6. The composition as recited in claim 1 wherein at least one carboxylic acid is reacted with the tertiary amine and the mercaptocarboxylic acid, wherein said carboxylic acid(s) is of the formula:

$$X—CH_2—(CH_2)_n—COOH$$

wherein n is an integer from 0 to 2, and X is selected from the group consisting of H, OH and Cl.

7. The composition as recited in claim 6, wherein said carboxylic acids are selected from the group consisting of: acetic acid, propionic acid, butanoic acid, hydroxyacetic acid, hydroxypropionic acid, hydroxybutanoic acid, chloroacetic acid, chlorobutanoic acid and mixtures thereof.

8. The composition as recited in claim 1 further including an antifreeze agent.

9. The composition as recited in claim 8 wherein said antifreeze agent is methanol.

10. The composition as recited in claim 8 wherein said antifreeze agent is isopropyl alcohol.

11. The composition as recited in claim 1 further including at least one solvent.

12. The composition as recited in claim 11 wherein said solvents are selected from the group consisting of:

water;

isopropyl alcohol;

methanol; and mixtures thereof.

13. The composition as recited in claim 3 wherein said trialkylamine has two methyl groups and a partially saturated to saturated straight chain aliphatic containing from 12 to 22 carbon atoms.

14. The composition as recited in claim 1 which is soluble in water.

15. The composition as recited in claim 1 which is soluble in alcohols.

16. A composition for inhibiting corrosion as recited in claim 1, wherein said tertiary amines are reacted with said carboxylic acids in a molar ratio of 1:0.01 to 1:1.5, and most preferably 1:1.

17. The composition as recited in claim 1 wherein said reaction product is a mixture of carboxylic and mercaptocarboxylic acids salts of trialkylamines.

18. The composition as recited in claim 1 wherein said reaction product is a mixture of carboxylic and mercaptocarboxylic acids salts of alkylpyridines.

19. The composition as recited in claim 1 wherein said reaction product is a mixture of carboxylic and mercaptocarboxylic acids salts of alkylquinolines.

20. The composition as recited in claim 1 wherein said reaction product is of the formulae:

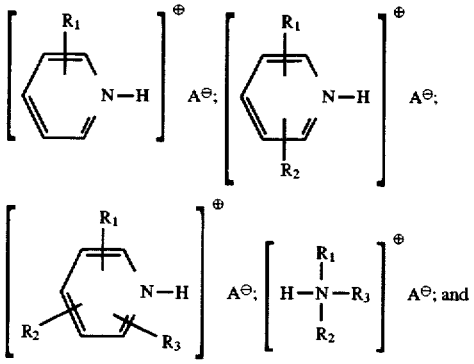

-continued

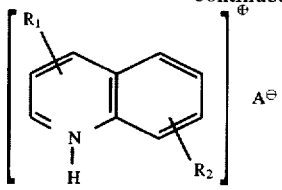

wherein $R_1$, $R_2$, and $R_3$ are alkyl groups, and A is a compound of the following formula:

$$SH—CH_2—(CH_2)_n—COO$$

wherein n is an integer from 0 to 2.

21. A composition for inhibiting corrosion selected from the group consisting of:

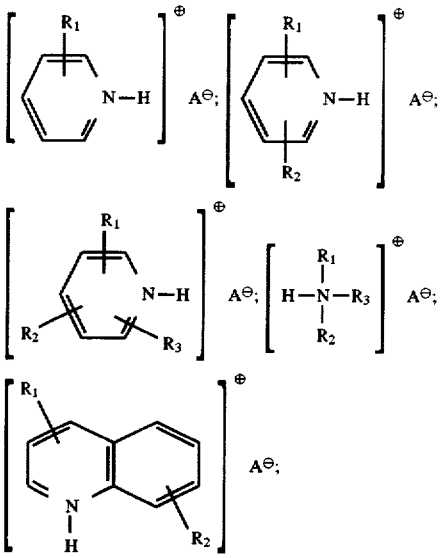

and mixtures thereof, wherein $R_1$, $R_2$, and $R_3$ are alkyl groups, and A is a compound of the following formula:

$$SH—CH_2—(CH_2)_n—COO$$

wherein n is an integer from 0 to 2.

22. The composition as recited in claim 1 further including a surfactant.

23. The composition as recited in claim 22 wherein said surfactant is selected from the group consisting of:

ethoxylated alcohol;

ethoxylated amine; and mixtures thereof.

24. A composition for inhibiting corrosion comprising:

28% by weight pyridine derivatives;

30% by weight water;

30% by weight isopropyl alcohol;

7% by weight surfactant; and

5% by weight of a mixture of at least one mercapto carboxylic acid and carboxylic acids.

25. The composition as recited in claim 24 wherein said 5% by weight of a mixture of at least one mercapto carboxylic acid and carboxylic acids includes 0.50 to 2.50% by weight mercaptocarboxylic acid.

26. The composition as recited in claim 1, wherein the mercaptocarboxylic acid is in an amount no greater than 0.5%, by weight.

27. The composition of claim 1, wherein the mercaptocarboxylic acid is in an amount ranging from 0.5% to 2.5%, by weight.

28. The composition of claim 1 wherein the tertiary amine component contains at least a measurable amount of picoline or picoline derivative.

29. The composition of claim 1 wherein the reaction between the tertiary amine and the mercapto carboxylic acid(s) occurs at ambient pressures and temperatures.

30. A method of inhibiting corrosion on metal surfaces comprising the step of: adding to a corrosive fluid in contact with the metal surface an effective amount of a corrosion inhibitor comprising the reaction product of at least one tertiary amine and at least one mercapto carboxylic acid, wherein said mercapto carboxylic acid is of the formula:

$$SH—CH_2—(CH_2)_n—COOH$$

wherein n is an integer from 0 to 2.

31. The method as recited in claim 30 wherein said effective amount of said corrosion inhibitor is an amount that reduces the corrosion rate on said metal surface to one tenth the rate of corrosion prior to adding the inhibitor or less.

32. The method of inhibiting corrosion in iron and iron alloy metals which comprises the step of: adding to a corrosive fluid in contact with said metal the reaction product of at least one tertiary amine, at least one mercapto carboxylic acid of the formula:

$$SH—CH_2—(CH_2)_n—COOH$$

wherein n is an integer from 0 to 2, and optionally, another carboxylic acid of the formula:

$$X—CH_2—(CH_2)_n—COOH$$

wherein n is an integer from 0 to 2 and X is selected from the group consisting of H, OH and Cl.

33. The method of inhibiting corrosion in steel which comprises the step of: adding to a corrosive fluid in contact with said metal the reaction product of at least one tertiary amine, at least one mercapto carboxylic acid of the formula:

$$SH—CH_2—(CH_2)_n—COOH$$

wherein n is an integer from 0 to 2, and optionally, another carboxylic acid of the formula:

$$X—CH_2—(CH_2)_n—COOH$$

wherein n is an integer from 0 to 2, and X is selected from the group consisting of H, OH and Cl.

34. The method of inhibiting corrosion in oil and gas pipelines which comprises the step of: adding to a corrosive fluid in contact with said oil and gas pipelines the reaction product of at least one tertiary amine, at least one mercapto carboxylic acid of the formula:

$$SH—CH_2—(CH_2)_n—COOH$$

wherein n is an integer from 0 to 2, and optionally, another carboxylic acid of the formula:

$$X—CH_2—(CH_2)_n—COOH$$

wherein n is an integer from 0 to 2, and X is selected from the group consisting of H, OH and Cl.

35. The method of inhibiting corrosion which comprises the step of:

continuously injecting into a corrosive fluid the reaction product of at least one tertiary amine, at least one mercapto carboxylic acid of the formula:

$$SH—CH_2—(CH_2)_n—COOH$$

wherein n is an integer from 0 to 2, and optionally, another carboxylic acid of the formula:

$$X—CH_2—(CH_2)_n—COOH$$

wherein n is an integer from 0 to 2, and X is selected from the group consisting of H, OH and Cl.

* * * * *